United States Patent [19]

Bajohr et al.

[11] Patent Number: 4,731,033

[45] Date of Patent: Mar. 15, 1988

[54] INSTANT CONNECTOR FOR THE CONTACTING OF TWO ELECTRICAL WIRES

[75] Inventors: Walter Bajohr, Troisdorf; Willi Bornheim, Troisdorf-Oberlar, both of Fed. Rep. of Germany

[73] Assignee: Dynamit Nobel Aktiengesellschaft, Fed. Rep. of Germany

[21] Appl. No.: 896,872

[22] Filed: Aug. 15, 1986

[30] Foreign Application Priority Data

Aug. 16, 1985 [DE] Fed. Rep. of Germany ..... 3529443

[51] Int. Cl.[4] ..... H01R 4/24

[52] U.S. Cl. ..... 439/395; 439/410; 439/796

[58] Field of Search ..... 339/99 R, 98, 97 R, 339/97 P, 248 S, 95 D; 439/395, 410, 796

[56] References Cited

U.S. PATENT DOCUMENTS

| | | | |
|---|---|---|---|
| 2,359,541 | 10/1944 | Bancroft | 339/248 S |
| 3,766,514 | 10/1973 | Kimm | 339/99 R |
| 4,451,104 | 5/1984 | Hodgson | 339/99 R |

*Primary Examiner*—William R. Briggs

*Attorney, Agent, or Firm*—Antonelli, Terry & Wands

[57] ABSTRACT

An instant connector has a synthetic resin housing comprising two blind ducts projecting into the housing from opposite end faces and extending in parallel to each other. A contact blade is arranged in a cavity between the blind ducts. This blade is pivotable about an axis extending in parallel to the end faces and the ends of the blade-project obliquely into the blind ducts. Upon the introduction of wires into the blind ducts, the ends of the contact blade engage these wires. By subsequently pulling the wires apart; i.e., away from each other, the ends of the contact blade burrow through the insulating sheaths of the wires into the wire cores. In this manner, the wires are electrically connected with each other by way of the contact blade.

10 Claims, 5 Drawing Figures

INSTANT CONNECTOR FOR THE CONTACTING OF TWO ELECTRICAL WIRES

This invention relates to an instant connector for contacting of two electrical wires.

It is frequently necessary to electrically connect electrical wires provided with an insulating sheath. During preparation of a blasting operation, detonators are introduced together with the explosive charge into the prepared drill holes, the ignition wires protruding toward the outside from the drill holes. After this preparation, the ignition wires are connected to one another. In this operation, it is necessary to pull off the insulation from the wires in a length of about 50 mm and to join two bare wire ends of different detonators with each other by twisting. Subsequently, the bare, twisted-together wire ends are inserted in an insulating sleeve in order to protect the detonator against stray currents, electrostatic charging, and the like. These operations are not only expensive, but can also result in mismatching or connecting errors.

The invention is based on the object of providing an instant connector of the type discussed hereinabove which makes it possible to connect electrical wires quickly, simply, and securely with one another, and which can be manufactured in a simple and economical fashion.

This object has been attained according to this invention wherein a flat housing is provided exhibiting on two opposed end faces, respectively, one opening of a blind duct for an electrical conductor; the blind ducts are mutually offset in the transverse direction of the housing and extend essentially in parallel to each other; the housing comprises a cavity extending transversely between the blind ducts wherein a contact blade is pivotably mounted about an axis extending in parallel to the end faces; and stops are provided in the housing limiting the movement of the contact blade in such a way that, in one position, the ends of the contact blade project obliquely into the blind ducts in a direction toward the closed ends of the blind ducts and, in another position of the contact blade, the ends are aligned essentially at a right angle to the blind ducts.

When using the instant connector, the wires to be joined are inserted from opposite sides in the openings of the housing. The inserted wire end initially abuts against the end of the contact blade projecting into the blind duct, this end being initially urged forwardly and toward the side thereby permitting the wire to pass through and into the close section of the duct. After both wire ends have been inserted in the housing, the contact blade is initially still in the oblique position. By subsequently exerting a pull on each of the two wires; i.e., drawing the wires apart in opposite directions, the contact blade assumes a crosswise or transverse position in the housing, the ends of the contact blade burrowing into the wires. If the wires have an insulating sheath, the sheath is cut open by the ends of the contact blade so that the contact blade enters into firm engagement with the wire core.

The instant connector of this invention is especially suitable for joining the wires of electrical detonators. Such detonators, as utilized for blasting operations in mining and the like, are normally connected in series and placed in connection with a detonator machine. Each detonator has two ignition wires. One of these ignition wires can be inserted in the instant connector of this invention during its manufacture so that then it is merely necessary at the usage site to introduce the free ignition wire of another detonator into the still vacant blind duct of the instant connector. Since the contact blade is already in engagement with the first inserted ignition wire, it is ensured that the instant connector is nondetachably secured to this first detonator wire and cannot be unintentionally released therefrom.

The housing of the instant connector of this invention consists preferably of two essentially identical, shell-like housing members, each of which forms one cross-sectional half of the blind ducts and of the centrally located cavity. The housing members may be joined by a film hinge along adjacent sides and can be manufactured together in one piece. After production of the housing members, it is merely necessary to insert the contact blade, which is made of metal, and to fold the housing members over on each other. Thereafter, the housing members are fixed in place relatively to each other and sealingly joined by means of ultrasonic welding, gluing, or the like. Manufacture and assembly of the instant connector can in this way be accomplished in a quick and simple way. It will be appreciated that it is also contemplated by this invention to form the two housing members as separate members without a film hinge and to seal the two members together after insertion of the contact blade.

In order to prevent moisture from penetrating into the housing, each blind duct exhibits preferably a sealing lip between the opening and the cavity, this lip sealingly contacting the periphery of the inserted wire. This sealing lip consists of two parts, each part being formed integrally with one of the two housing halves. Alternatively or in addition, the cavity can contain a hydrophobic composition, for example a grease, preventing the entrance of moisture.

One embodiment of the invention will be described in greater detail below with reference to the accompanying drawings wherein.

Figure 1:
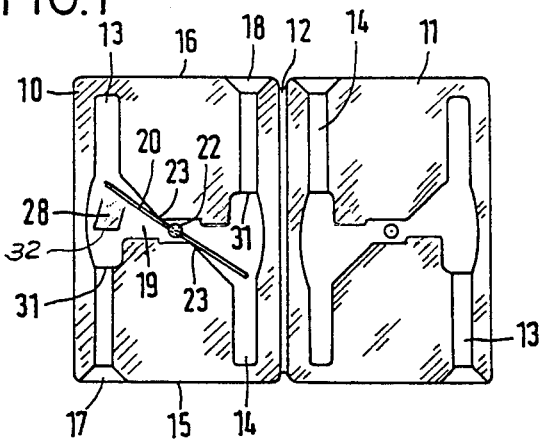
FIG. 1 shows a view of the housing with the housing halves being flipped open.

The connector of this invention, as illustrated in FIG. 1, consists of two flat, rectangular housing members 10, 11 joined along adjacent narrow sides by means of a film hinge 12 made of the same material forming the housing members. Both housing members 10 and 11 exhibit essentially the same outer configuration. Both housing members 10 and 11 contain, respectively, one cross-sectional half of each of the blind ducts or bores 13, 14. When the upper housing member 11 has been folded over on the lower housing member 10 to form a closed housing, one blind duct 13 extends from one end face 15 of the closed housing into the interior of the housing. The end of the blind duct 13 facing away from the opening 17 is sealed. The other blind duct 14 extends from the opening 18 in the end face 16 of the closed housing into the housing, and its opposite end is sealed. Both blind ducts 13 and 14 extend in parallel to each other, and each of these blind ducts extends almost over the entire length of the closed housing.

A cavity 19 joining the blind ducts 13 and 14 with each other is located in the center of the housing. A contact blade 20 is pivotably mounted in the cavity 19. The contact blade, as shown in greater detail in FIG. 5, consists of a strip of thin steel sheet. Two lugs 21 project toward opposite sides from the center of the length of the strip. These lugs 21, which are arranged in the plane of the strip and which projects into a blind hole 22 and 22' of each housing member 10 and 11, constitute the pivot axis of the contact blade 20. This pivot axis extends in parallel to the end faces 15 and 16 of the housing.

Figure 2:
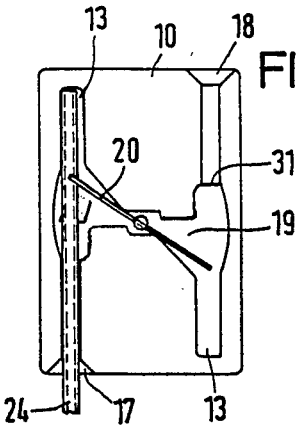
FIG. 2 is a view of the lower housing half with the first wire having been inserted.

The cavity 19 is delimited by two first stops 23 against which the contact blade abuts when one of the wires 24 or 25 is pushed into the respective blind duct 13 or 14. For example, if the wire 24 is pushed into the blind duct 13, the end of this wire abuts against the contact blade 20 which latter is then urged against the stops 23. In this condition, the ends of the contact blade project obliquely into the blind ducts 13 and 14; namely, in the direction toward the sealed end of the respective blind duct. The contact blade is bent by the pressure of the wire so that the blade end contacting the wire 24 springs outwardly and urges the wire 24 (FIG. 2) against the outside of the blind duct 13. In this way, the wire 24 is held with clamping force in the blind duct 13. If an attempt were made to pull the wire 24 in the position according to FIG. 2 out of the housing, then the end of the contact blade 20 would cut into the wire and block such pulling-out effort thereby preventing removal of the wire 24 from the housing.

Figure 3:
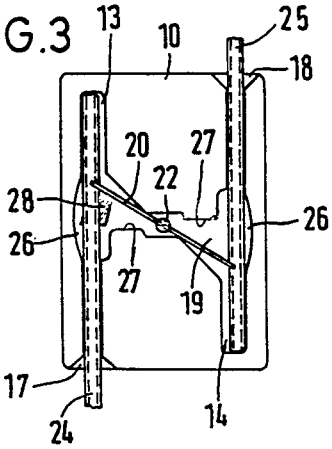
FIG. 3 shows the same view as FIG. 2 with two wires having been inserted.

After insertion of the first wire 24, the second wire 25 can be pushed into the housing from the opposite end (FIG. 3). Also, this second wire 25 is retained by the contact blade 20, the end of the blade projecting obliquely into the blind duct 14.

Figure 4:
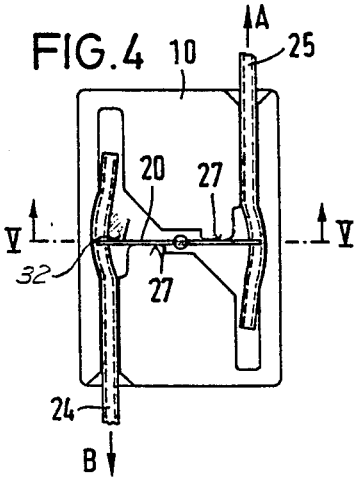
FIG. 4 shows the same view as FIG. 2 after exertion of a pulling force on the wires, in the final condition of the instant connector.

Each blind duct 13 and 14 exhibits in the pivoting range of the contact blade 20 a laterally located arcuate, widened portion 26 into which the respective section of the wire 24 or 25 is urged by the contact blade 20 (FIG. 4). This happens by the exertion of a tensile stress on the inserted wires, in accordance with arrows A and B in FIG. 4; i.e., by pulling these wires outwardly after insertion in the housing. The contact blade 20 then assumes a transverse position in the housing, the ends of the blade urging the wires 24 and 25 further apart and forming a section of each into the associated arcuate portion 26. Second stops 27 serve to retain the blade 20 in this transverse position.

A ramp 28 with an elevated edge 32, is provided in the cavity 19 at the lower housing part 10, the lower edge of the contact blade 20 running up on this ramp and sliding down after passing the edge 32 during the pivoting movement so that the contact blade, in the locked condition, is clamped in place between the two housing parts 10 and 11.

Figure 5:
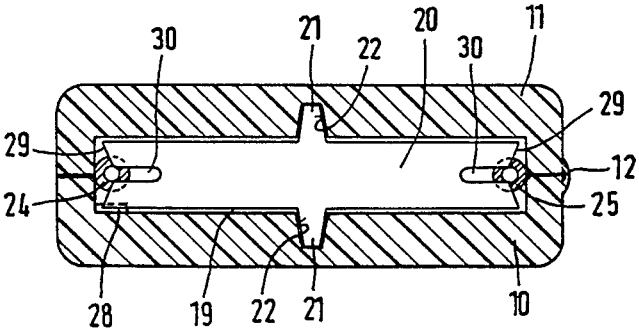
FIG. 5 shows a section taken along line V—V of FIG. 4.

The shape of each of the ends of the contact blade 20 can be seen from FIG. 5. Each end has a V-shaped cutout 29 adjoined by an elongated slot 30. The edge between the cutout 29 and the elongated slot 30 penetrates the insulating sheath around the respective wire 24 or 25 and presses itself into the wire core. In this way, an electrical contact is established between each wire core and the conductive contact blade. By way of the contact blade 20, the cores of the wires 24 and 25 are placed into electric connection with each other. The housing members 10 and 11 consist of an insulating material, especially a synthetic resin.

As can be seen from the drawings, each zone of the blind duct 13 or 14 facing and immediately adjacent to the opening 17 or 18, respectively, has a cross section substantially corresponding to the external diameter of the wire 24 or 25. Each subsequent section of the blind duct 13 or 14; i.e., the section adjacent to the closed end of the duct, has a somewhat larger cross section.

A sealing lip 31 integrally formed with the housing member 10 and 11 is disposed between the cavity 19 and the opening or inlets 17 or 18 of the respective blind duct. This flexible sealing lip of a synthetic resin sealingly surrounds the inserted wire to prevent moisture from penetrating into the interior of the housing.

The edges of the ends of the contact blade 20 are fashioned in the manner of cutters; i.e., they are beveled in order to be able to cut into the insulating jacket and/or the wire core.

The instant connector is suitable for the connection of insulated wires 24, 25; it is unnecessary, in this arrangement, to bare the wires beforehand. On the other hand, it is also possible to use the instant connector for the connection of bare wires, if necessary.

What is claimed is:

1. An instant connector for contacting two electrical wires, which comprises a flat housing exhibiting on two mutually opposed end faces, respectively, one opening of a blind duct for an electrical conductor, the blind ducts being mutually offset in the transverese direction of the housing and extending essentially in parallel to each other; the housing comprising a cavity extending transversely between the blind ducts wherein a contact blade is mounted to be pivotable about an axis extending in parallel to the end faces; and stops in the housing for limiting the movement of the contact blade in such a way that, in a first end position, the ends of the contact blade project obliquely into the blind ducts in the direction toward closed ends of the ducts and, in a second end position, the contact blade is aligned essentially at a right angle to the blind ducts; the ends of the contact blade having v-shaped cutout portions and base zones of the cutout portions of the ends of the contact blade, respectively, terminating in an elongated slot.

2. An instant connector according to claim 1, wherein the blind ducts exhibit, in the pivoting ranges of the ends of the contact blade, respectively, one arcuate widened portion into which, when the contact blade is in the transverse position, a section of the respective wire is pressed.

3. An instant connector according to claim 1 or 2, wherein the housing consists of two substantially shell-like housing parts each of these forming one cross-sectional half of the blind ducts and of the cavity.

4. An instant connnector according to one of claims 1 and 2, wherein the contact blade consists of a strip, exhibiting two lugs projecting in the plane of the strip toward opposite directions, these lugs engaging into blind holes of upper and lower broad sides of the housing.

5. An instant connector according to claim 1, wherein said contact blade comprises a strip of thin metal sheet.

6. An instant connector according to claim 5, wherein the strip of thin metal sheet has two lugs which project from a center of the length of the contact blade in opposite directions, said lugs projecting into holes in the housing and the lugs providing a pivot axis for the contact blade.

7. An instant connector for contacting two electrical wires, which comprises a flat housing exhibiting on two mutually opposed end faces, respectively, one opening of a blind duct for an electrical conductor, the blind ducts being mutually offset in the transverse direction of the housing and extending essentially in parallel to each other; the housing comprising a cavity extending transversely between the blind ducts wherein a contact blade is mounted to be pivotable about an axis extending in parallel to the end faces; and stops in the housing for limiting the movement of the contact blade in such a way that, in a first end position, the ends of the contact blade project obliquely into the blind ducts in the direction toward closed ends of the ducts and, in a second end position, the contact blade is aligned essentially at a right angle to the blind ducts; at least one ramp being provided in the cavity onto which runs up an edge of the contact blade during movement into the second end position.

8. An instant connector according to claim 1, wherein each blind duct has a sealing lip between the opening and the cavity, said sealing lip being in sealing contact with the periphery of an inserted wire.

9. An instant connector according to claim 1, wherein the cavity contains a hydrophobic composition preventing the entrance of moisture.

10. An instant connector according to claim 3, wherein both housing members are manufactured in one piece and are joined along their narrow sides by means of an integrally formed film hinge.

* * * * *